US006945737B1

(12) United States Patent
Xu

(10) Patent No.: US 6,945,737 B1
(45) Date of Patent: Sep. 20, 2005

(54) SINGLE COLUMN EXTENDABLE DRAFT OFFSHORE PLATFORM

(75) Inventor: Qi Xu, Katy, TX (US)

(73) Assignee: Technip France, Courbevoie (FR)

( * ) Notice: Subject to any disclaimer, the term of this patent is extended or adjusted under 35 U.S.C. 154(b) by 0 days.

(21) Appl. No.: 10/789,035

(22) Filed: Feb. 27, 2004

(51) Int. Cl.[7] ..... E02D 23/02; B63B 35/44

(52) U.S. Cl. ..... 405/205; 405/195.1; 405/200; 405/203; 114/125; 114/264; 114/266

(58) Field of Search ..... 405/195.1, 196, 405/200–207, 210; 114/121, 125, 264, 266

(56) References Cited

U.S. PATENT DOCUMENTS

| | | | | | |
|---|---|---|---|---|---|
| 3,408,821 | A | * | 11/1968 | Redshaw | 114/264 |
| 3,474,749 | A | | 10/1969 | Williamson | 114/0.5 |
| 3,673,973 | A | | 7/1972 | Glosten | 114/0.5 |
| 3,921,558 | A | * | 11/1975 | Redshaw | 114/264 |
| 4,451,174 | A | * | 5/1984 | Wetmore | 405/196 |
| 4,646,672 | A | | 3/1987 | Bennett et al. | 114/264 |
| 4,648,751 | A | * | 3/1987 | Coleman | 405/209 |
| 4,697,956 | A | * | 10/1987 | Plaisance | 405/213 |
| 5,609,442 | A | * | 3/1997 | Horton | 405/205 |
| 6,213,045 | B1 | | 4/2001 | Gaber | 114/266 |
| 6,367,399 | B1 | | 4/2002 | Khachaturian | 114/61.1 |
| 6,565,286 | B2 | * | 5/2003 | Carr et al. | 405/205 |
| 6,718,901 | B1 | * | 4/2004 | Abbott et al. | 114/264 |
| 6,786,679 | B2 | * | 9/2004 | Huang et al. | 405/205 |
| 2002/0154954 | A1 | | 10/2002 | Huang et al. | 405/200 |

FOREIGN PATENT DOCUMENTS

| | | | |
|---|---|---|---|
| GB | 2147549 | * | 5/1985 |

* cited by examiner

*Primary Examiner*—Jong-Suk (James) Lee
(74) *Attorney, Agent, or Firm*—Klein, O'Neill & Singh, LLP; Howard J. Klein

(57) ABSTRACT

An extendable draft offshore oil and gas drilling and production platform ("EDP") includes a buoyant deck having a central opening, an adjustably buoyant pontoon, and a single, adjustably buoyant column. The column is mounted upright on the pontoon, and is vertically movable through the central opening of the deck. The deck is supported on an upper end of the column above a body of water for offshore operations. The pontoon, and optionally, the column, have compartments with a buoyancy that is adjustable by pumps or sea water ballast and pressurized air. In one embodiment, the compartments can comprise a plurality of tubes. In another embodiment, a lower end of the column may comprise an open truss structure. The platform combines the advantages of a SPAR platform with those of a deep draft extendable draft platform.

10 Claims, 8 Drawing Sheets

FIG.13
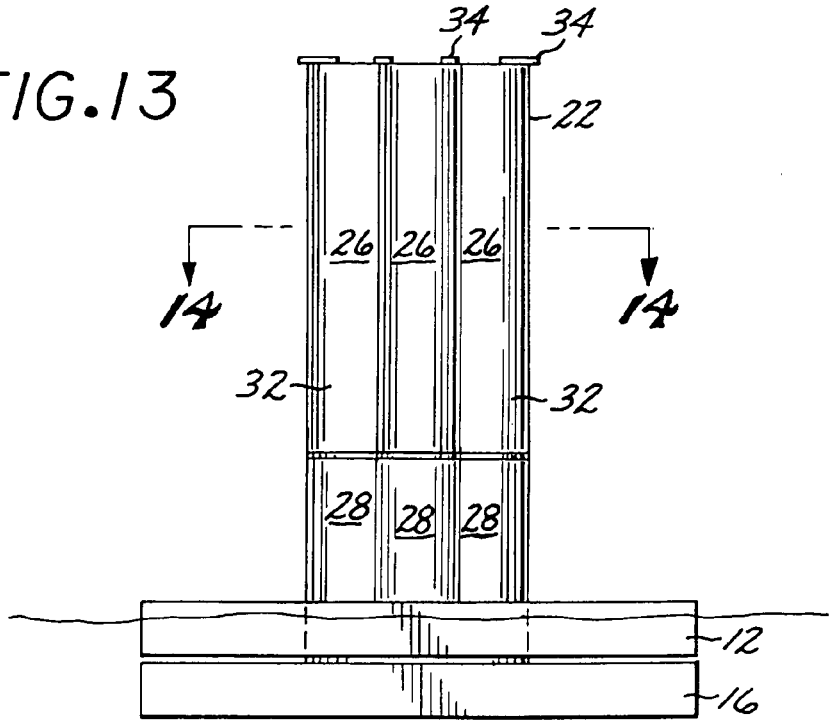
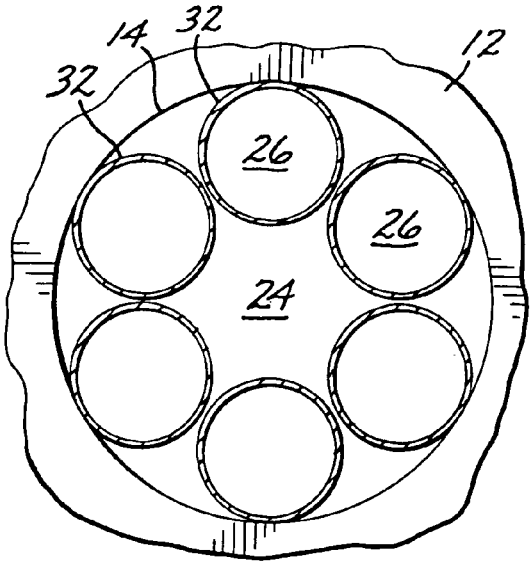
FIG.14
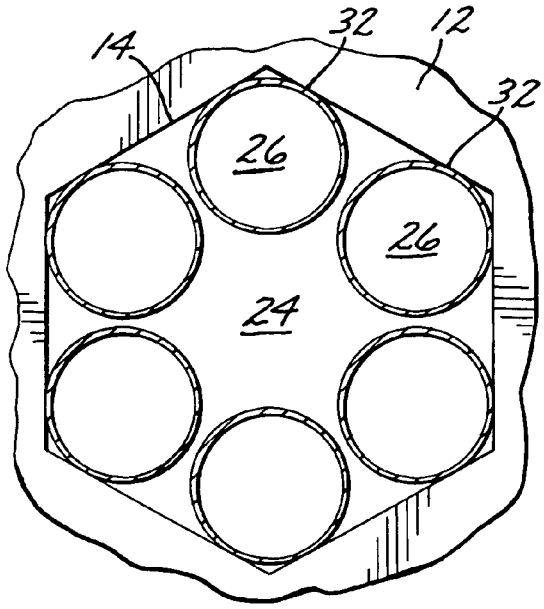
FIG.15

SINGLE COLUMN EXTENDABLE DRAFT OFFSHORE PLATFORM

CROSS-REFERENCE TO RELATED APPLICATIONS (Not Applicable)

STATEMENT REGARDING FEDERALLY SPONSORED RESEARCH OR DEVELOPMENT (Not Applicable)

REFERENCE TO APPENDIX (Not Applicable)

BACKGROUND OF THE INVENTION

1. Field of the Invention

This invention relates to floating vessels useful for offshore oil and gas drilling and production operations in general, and in particular, to a deep-draft, semi-submersible, extendable-draft platform ("EDP") that incorporates a single, centrally located support column to minimize platform cost, complexity and motions resulting from surface wind and wave forces.

2. Related Art

The development of deep water offshore oil and gas fields, such as are found in the Gulf of Mexico and the North Sea, present substantial challenges to the petroleum industry. Early production schedule requirements necessitate maximal inshore integration and commissioning, together with a year-round deployment capability. Moreover, the ability to use so-called "dry trees" and steel catenary risers ("SCRs") requires that the motions of the deployed structures in response to wind and waves be relatively small, even in seasons with rough seas.

Such offshore oil and gas operations involve the provision of a vessel or working platform in which the drilling, production and storage equipment, together with the living quarters of the personnel manning the platform, if any, are integrated. In general, offshore platforms fall into one of two groups, viz., "fixed" and "floating" platforms. Fixed platforms comprise a "topside," or equipment deck, that is supported above the water by legs that extend down to and are seated, directly or indirectly, on the sea floor. While relatively stable, such fixed platforms are typically limited to shallow waters, i.e., depths of about 500 feet (150 m) or less.

Floating platforms are typically employed in water depths of 500 ft. (154 m) and greater, and are held in position over the well site by mooring lines or chains anchored to the sea floor, or by motorized thrusters located on the sides of the platform, or by both. Although floating platforms are more complex to operate because of their greater movement in response to wind and wave conditions, they are capable of operating at substantially greater depths than fixed platforms, and are also more mobile, and hence, easier to move to other offshore well sites. There are several known types of floating platforms, including so-called "drill ships," "tension-leg" platforms ("TLPs"), "spar" platforms ("SPARs"), and "semi-submersible" platforms.

Spar platforms comprise a single, long, slender, buoyant hull that gives the platform the appearance of a column or spar when floating in an upright operating position, in which an upper portion of the platform extends above the waterline and a lower portion is submerged below it. Because of their relatively slender, elongated shape, they provide structural simplicity and compactness, and present a smaller area of resistance to wind and wave forces than do other types of floating platforms. However, the offshore installation of their equipment deck requires the use of a heavy-duty crane barge. Additionally, they have a relatively low hull efficiency, and their off-shore hook-up and connection procedures are relatively time-consuming and expensive. Examples of spar-type floating platforms useful for oil and gas exploration, drilling, production, storage, and gas flaring operations may be found in, e.g., U.S. Pat. Nos. 6,213,045; 5,443,330; 5,197,826; 4,740,109; 4,702,321; 4,630,968; 4,234,270; 3,510,892; and 3,360,810.

Conventional semi-submersible offshore platforms are used primarily in offshore locations where the water depth exceeds about 300 ft. (91 m). This type of platform comprises a hull structure that has sufficient buoyancy to support the equipment deck above the surface of the water. The hull typically comprises one or more submersible "pontoons" that support a plurality of vertically upstanding columns, which in turn support the deck above the surface of the water. The size of the pontoons and the number of columns are governed by the size and weight of the deck and equipment being supported.

A typical shallow-draft semi-submersible platform has a relatively small draft, typically, about 100 ft. (30.5 m), and incorporates a conventional catenary chain-link spread-mooring arrangement for station-keeping over the well sites. The motions of these types of semi-submersible platforms are relatively large, and accordingly, they require the use of "catenary" risers (either flexible or semi-rigid), extending from the seafloor to the work platform because they are not capable of supporting the other types of risers, e.g., top-tensioned vertical risers ("TTRs") that are typically employed in deep water operations. Also, heavy wellhead equipment must typically be installed on the sea floor, rather than on the work platform, for the same reason. Typical semi-submersible offshore platforms are described in the following references: CA 1092601; GB 2,310,634; U.S. Pat. No. 4,498,412; WO 85/03050; GB 1,527,759; WO 84/01554; GB 2,328,408; U.S. Pat. No. 6,190,089; GB 1,527,759; and, WO 02/00496.

An "extendable draft" platform, or "EDP," comprises a buoyant equipment deck having a plurality of openings ("leg wells") through the deck. Depending on the application, the deck may be rectangular or triangular, with a leg well at each corner or apex, although other configurations may also be used. A buoyancy column that can be ballasted (e.g., with seawater) is installed in each of the leg wells. The columns are initially deployed in a raised position, and then lowered to a submerged position after the EDP has been moved to a deep water site. Each column is divided by internal bulkheads into a plurality of compartments, and includes means for controllably forcing seawater ballast into and out of selected ones of the compartments to adjust the vertical position of the columns in the water, and hence, the draft of the platform. A "heave plate" or pontoon assembly is attached to the bottom of the columns to help stabilize the EDP against the heave action of wind, waves and swells.

One of the advantages of EDPs is that they are "self-installing," i.e., the hull and topside can be integrated at ground level at the fabrication yard, and no barge crane is required for off-shore deployment. However, they are still subject to increased current motions when compared to, e.g., SPAR platforms, because they typically incorporate from three to nine upright support columns, which extend up through the surface of the water and thereby increase the effective area of resistance of the platform to wind, wave and current forces acting at that level, as compared to a SPAR platform, which exposes only a single, long, slender, buoyant hull to such forces. Additionally, the use of multiple columns entails higher fabrication costs, and the leg wells are relatively wasteful of useful equipment deck area.

It would therefore be desirable if the structural simplicity, compactness and small exposure to wind, wave and current load of a SPAR platform could be combined with the inshore hull and topside integration and self-installing features of a deep draft EDP.

BRIEF SUMMARY OF THE INVENTION

In accordance with the present invention, an extendable draft offshore oil and gas drilling and production platform ("EDP") is provided that combines the structural simplicity, compactness, efficient use of deck space, and reduced resistance to surface level wind, wave and current forces of a SPAR platform with the easy fabrication and self-installing features of a deep draft EDP. The novel platform comprises a buoyant topside, or equipment deck, having a central opening, and an adjustably buoyant pontoon having a center well. A single buoyant support column having a center well is mounted upright on, and concentrically with the center well of, the pontoon, and is vertically movable through the central opening of the deck by adjusting the buoyancy, i.e., the sea water ballast, of the pontoon, and optionally, that of the column as well.

Means are provided for supporting the deck on an upper end of the column above a body of water. In one exemplary embodiment, these supporting means may comprise a plurality of short beams, or arms, which are fixed to the upper end of the column and which have a plurality of locking pin apertures formed about a circumferential periphery thereof, and a complementary, upstanding receptacle with corresponding locking pin apertures therein arranged on the deck around the central opening thereof to receive the circumferential periphery of the arms in a vertical, slide-in engagement. Locking pins extend through corresponding ones of the locking pin apertures of the arms and the receptacles to couple the deck to the upper end of the column and thereby raise the deck and support it above the water when the pontoon, and optionally, the column, are de-ballasted.

In one particularly advantageous embodiment, the column of the EDP may comprise a plurality of compartments, at least some of which have a buoyancy that can be adjusted, e.g., by sea water ballast that is forced into and out of the compartments with pressurized air or a pump. In another embodiment, the compartments may comprise a plurality of tubes. In yet another possible embodiment, the lower end portion of the column may comprise an open truss structure.

The cross-sectional shape of the respective center wells of the pontoon and the column may be circular, oval, or polygonal. Likewise, the respective horizontal peripheries of the deck and the pontoon may be polygonal, i.e., triangular, rectangular or square, in shape, depending on the particular application at hand. An upright derrick or crane may be slidably movable on an upper surface of the deck, e.g., on rails, between a working position disposed over the center well of the column, and an idle position horizontally displaced from the first.

A better understanding of the above and many other features and advantages of the present invention may be obtained from a consideration of the detailed description thereof below, particularly if such consideration is made in conjunction with the several views of the appended drawings.

BRIEF DESCRIPTION OF THE SEVERAL VIEWS OF THE DRAWINGS

FIG. 13 is an elevation view of an another alternative embodiment of a single column EDP in accordance with the present invention, showing the support column raised for surface towing of the platform;

FIGS. 14 and 15 are cross-sectional views of the EDP taken along the lines 14—14 in FIG. 13, showing possible alternative embodiments of the support column;

DETAILED DESCRIPTION OF THE INVENTION

Figure 1:
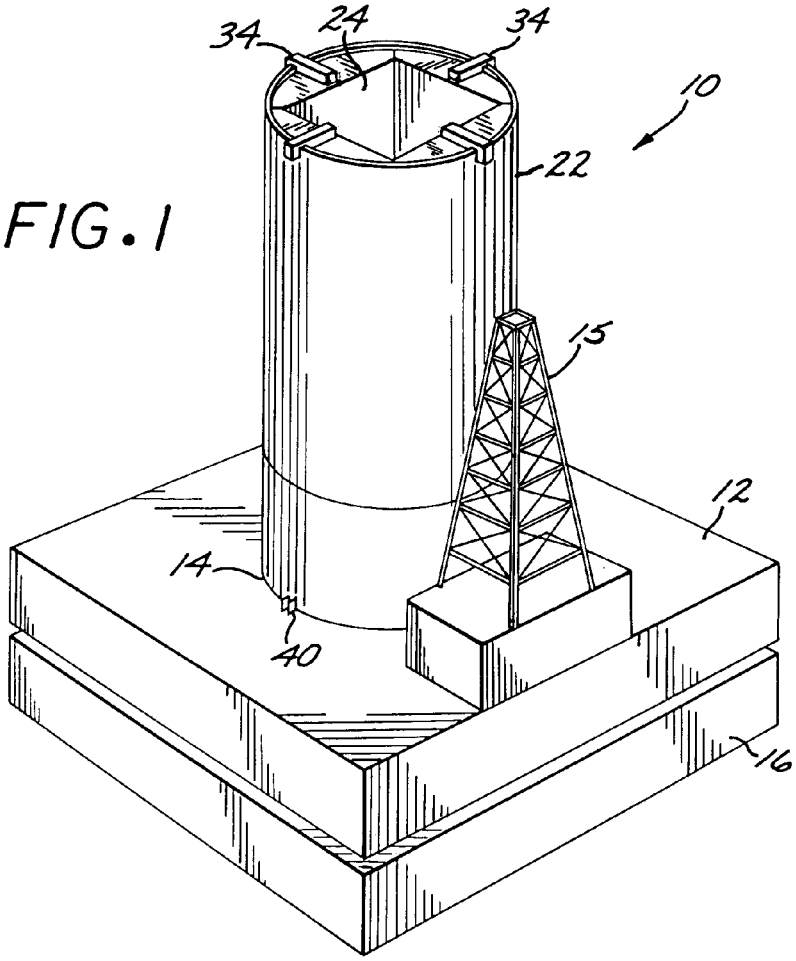
FIG. 1 is perspective view of an exemplary single column extendable draft offshore oil and gas drilling and production platform ("EDP") in accordance with the present invention.
Figure 2:
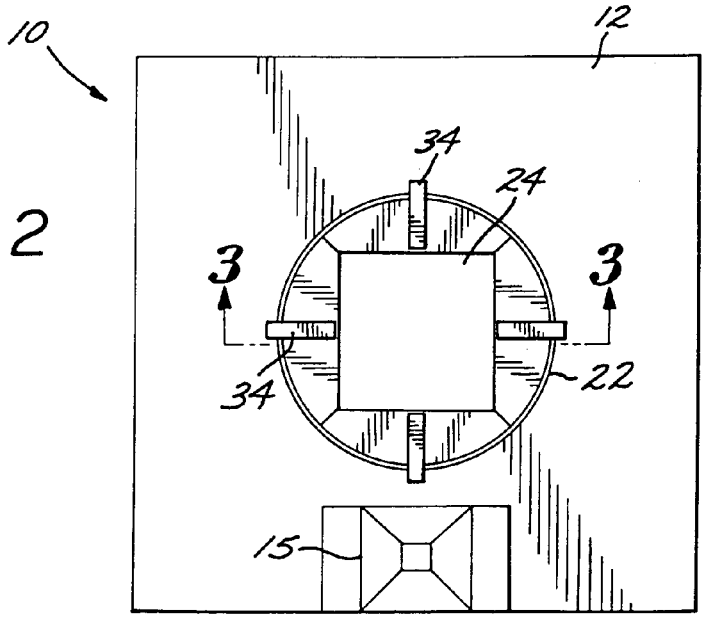
FIG. 2 is top plan view of the EDP of FIG. 1.

An exemplary single column extendable draft offshore oil and gas drilling and production platform ("EDP") 10 in accordance with the present invention is illustrated in the perspective and top plan views of FIGS. 1 and 2, respectively. As illustrated in the figures, the EDP comprises a buoyant "topside," or equipment deck 12, having an opening 14 at its center. The deck may be rectangular or square in its plan view, in the manner of a conventional barge, but may have other shapes as well, including triangular, or octagonal, depending on the particular application. In the particular embodiment illustrated in FIGS. 1 and 2, a derrick and associated draw works 15 are shown slidably disposed on the upper surface of the equipment deck, e.g., on tracks or rails (not illustrated), for movement between a first, or working, position over the central opening 14 of the deck, and a second, or idle, position horizontally displaced from the first position, to enable the single support column of the EDP described below to move up and down through the opening.

The exemplary EDP 10 further comprises a pontoon 16 having an adjustable buoyancy and an open center well 18

(see FIG. 3) disposed below the deck 12. In the particular embodiment illustrated in the figures, the pontoon has a rectangular periphery that generally conforms to that of the deck, but like the deck, may incorporate other peripheral shapes as well. The pontoon includes at least one, and preferably, a plurality, of internal compartments 20 that can be selectably flooded with and exhausted of seawater ballast to adjust its buoyancy. In the exemplary embodiment illustrated, the ballast compartments of the pontoon have openings to the ambient sea (not illustrated), together with vent pipes (not illustrated) that can be connected to the atmosphere, or alternatively, to a source of compressed air, to vent or blow the compartments and thereby enable precise control over the buoyancy of the pontoon, in a manner similar to that employed by submarines.

In accordance with the invention, the EDP 10 further comprises a single, buoyant support column 22 having a center well 24, and optionally, an adjustable buoyancy, as described in more detail below. The column is mounted upright on the pontoon 16 concentrically with the center well 18 of the latter, and is vertically movable through the central opening 14 of the deck 12 during deployment of the platform 10, as described below. In the particular embodiment illustrated in FIG. 3, the column comprises an upper, "hard tank," portion, i.e., one or more closed compartments 26 which have a buoyancy that is fixed, and a lower, "soft tank," portion, i.e., one or more compartments 28 that are open to the atmosphere and the ambient sea, which enables sea-water to enter them when they are lowered below the surface of the water, and to drain from them when they are raised above the water surface.

Figure 3:
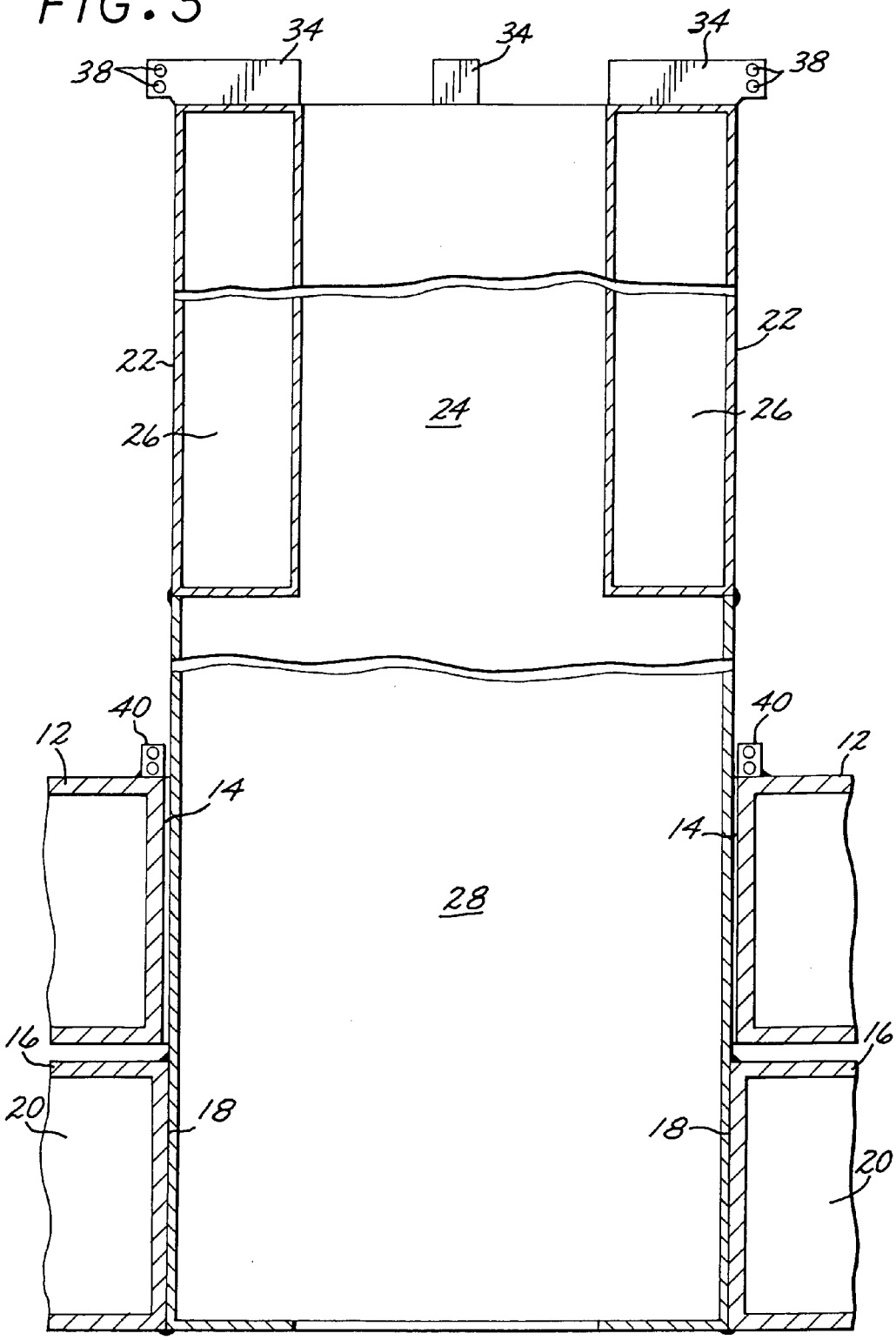
FIG. 3 is partial cross-sectional view of the EDP taken along the lines 3—3 in FIG. 2.
Figure 11:
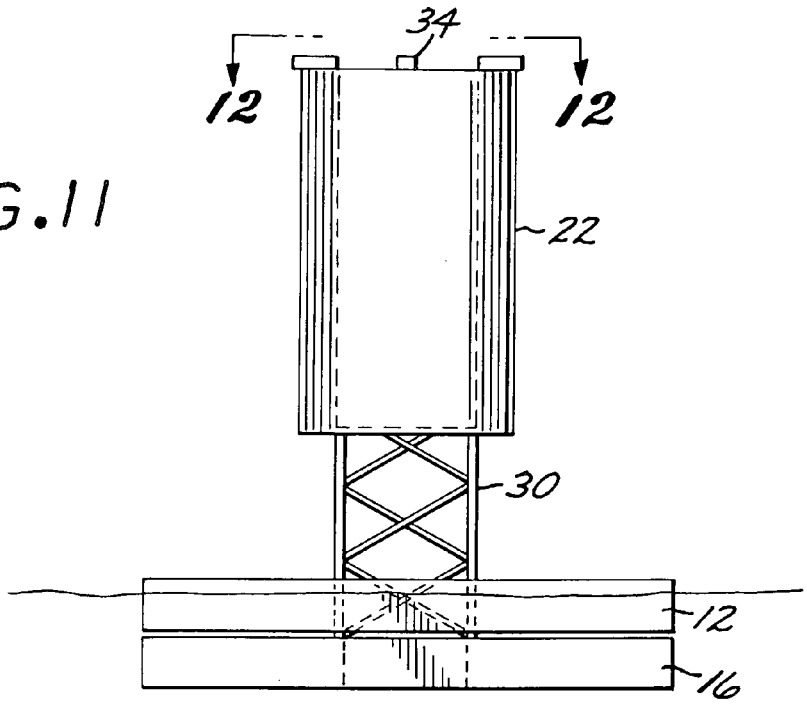
FIG. 11 is an elevation view of an alternative embodiment of a single column EDP in accordance with the present invention, showing the support column raised for surface towing of the platform.

The column 22 may be concentrically seated within the center well 18 of the pontoon 16, as illustrated in FIG. 3, or alternatively, may be mounted on the upper surface of the pontoon concentrically above its center well, as illustrated in FIG. 11, and in either case, such that central opening 14 of the deck 12 and the respective center wells 18 and 24 of the pontoon and the column are arranged coaxially. This arrangement defines a continuous center well extending through the pontoon, equipment deck and column through which risers, drill stem, casings, and the like can pass through the platform 10 to and from the sea floor below when the platform is operationally deployed.

In another possible alternative embodiment illustrated in FIG. 11, the lower, "soft tank" portion 28 of the column 22 can be replaced with an open truss structure 30. In yet another advantageous alternative embodiment illustrated in FIGS. 13–15, the closed "hard tank" compartments 26 and the "soft tank" lower portion 28 of the column can be replaced with a plurality of compartmentalized tubes 32. The lower ends of the tubes may be open to the sea, and means can be provided for controllably adjusting their buoyancy, e.g., pumps or compressed air and sea-water, as described above in connection with the pontoon 16. As further illustrated in FIGS. 14 and 15, the central opening 14 of the deck 12 can have a variety of cross-sectional shapes, including circular or polygonal.

Figure 4:
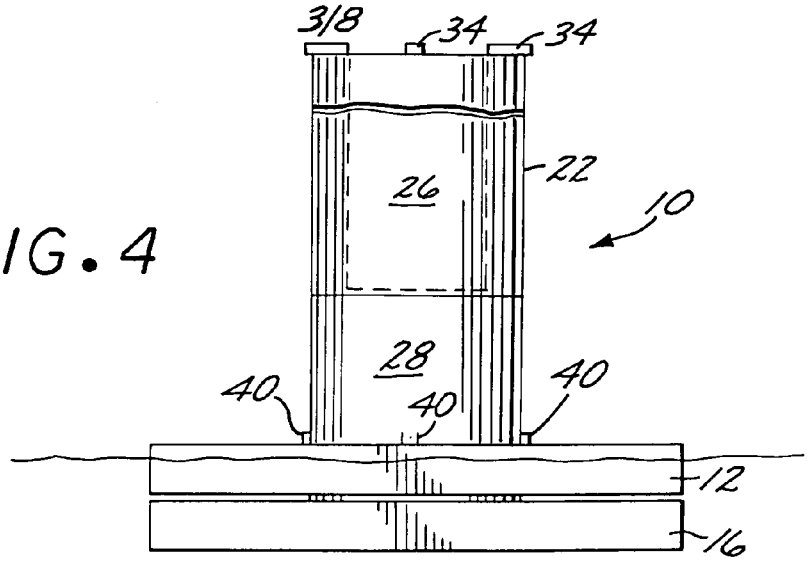
FIGS. 4–7 are elevation views of the EDP, showing successive stages of the offshore deployment thereof.

The procedure by which the EDP 10 is deployed for operations is illustrated sequentially in the elevation views of FIGS. 4–7. In FIG. 4, the EDP is shown configured for towing, i.e., both the pontoon 16 and the soft tank compartment 28 of the column 22 are substantially de-ballasted of seawater, such that the entire platform floats at a shallow draft. In this configuration, the platform can be towed, e.g., by ocean-going tugs, to an offshore operating location.

Figure 5:
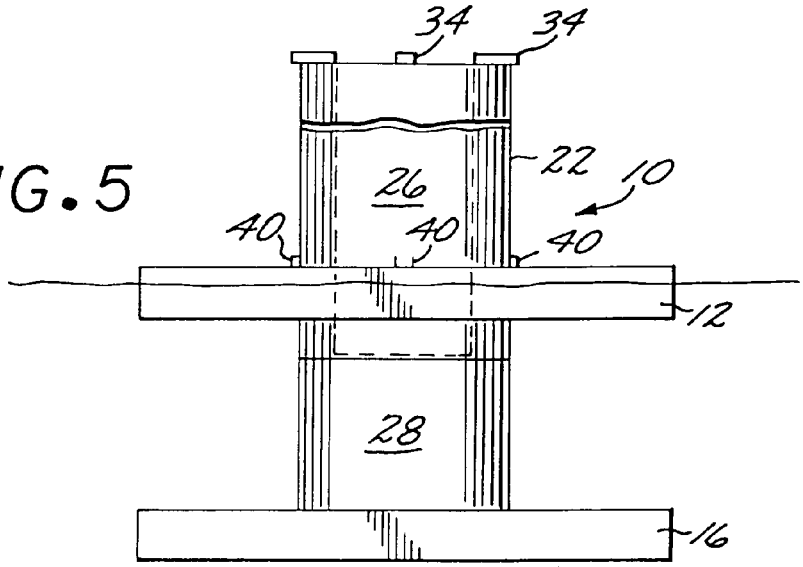
Figure 6:
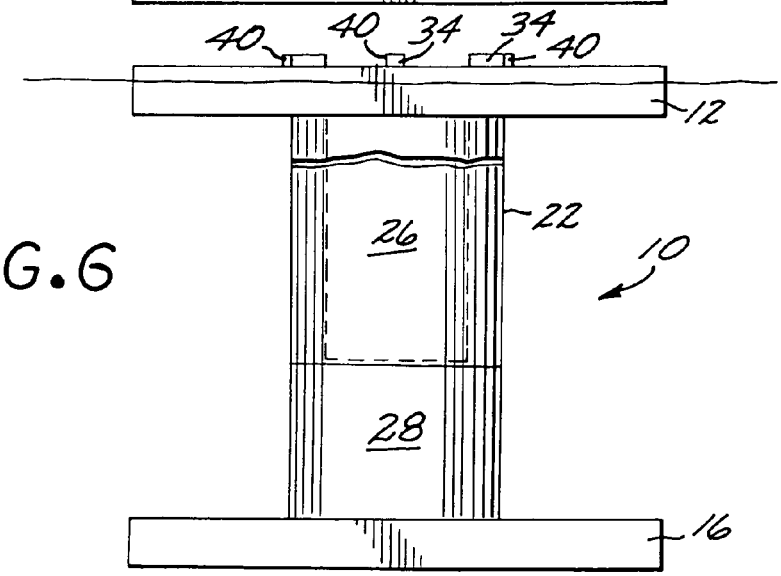

When the EDP 10 has been moved to the desired offshore location, ballasting of the pontoon 16 and column 22 with seawater is begun. The increasing weight of the ballast in these components causes the pontoon and column to submerge to a deep draft, while the buoyant equipment deck 12 remains floating on the surface, as illustrated in FIG. 5. The ballasting operation continues until the upper end of the column descends to the level of the upper surface of the deck, as illustrated in FIG. 6. At this stage, the deck is then rigidly connected to the upper end of the column, as described in more detail below.

Figure 7:
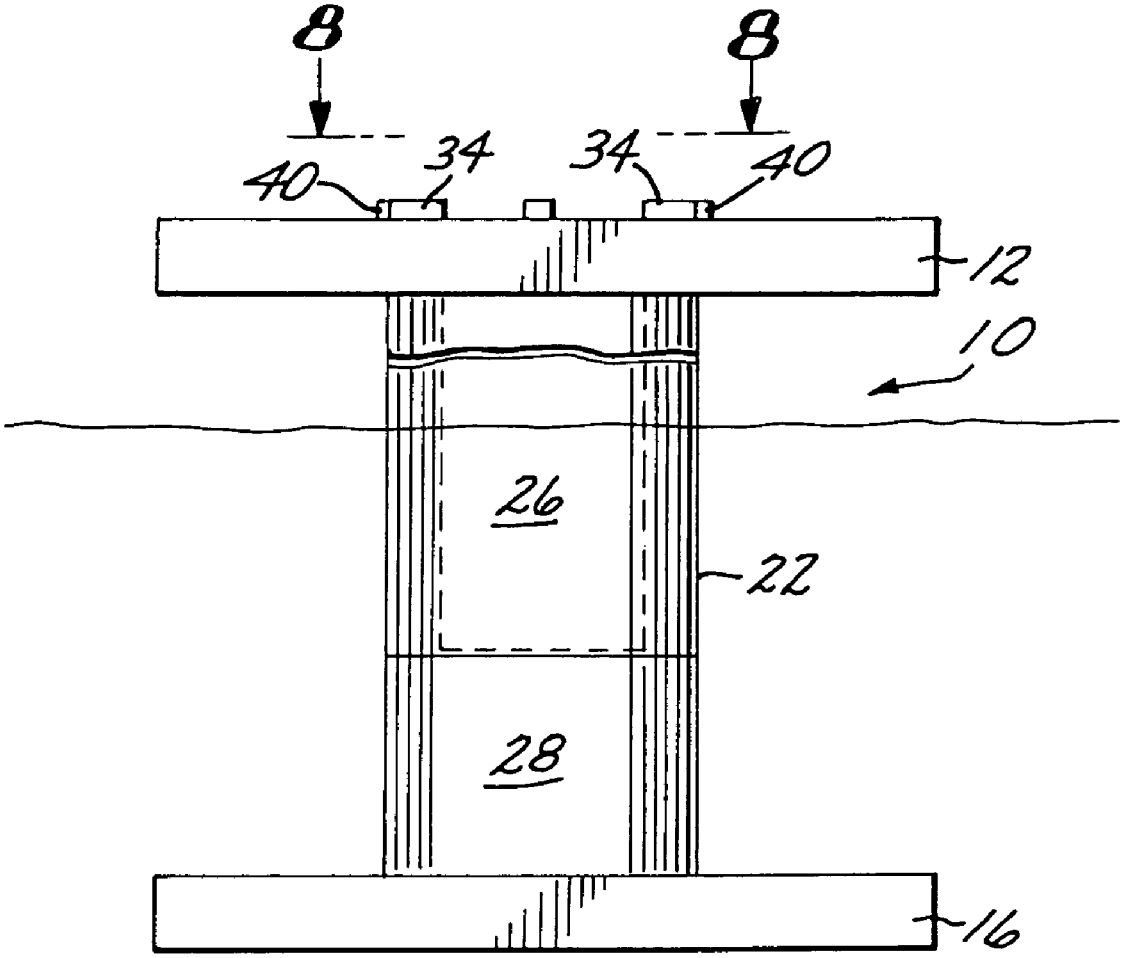

When the deck 12 has been connected to the upper end of the column 22, de-ballasting is effected, i.e., the forcing of seawater from the buoyant compartments of the column, such that the upper end of the column, with the deck rigidly connected thereto, is raised and supported a selected height above the surface of the water for commencement of operations, as illustrated in FIG. 7. Mooring lines (not illustrated) attached to the platform 10 and anchored in the seabed around its periphery are then selectably tensioned to hold the platform at the desired position above the work site. The EDP 10 is thus self-installing, as no offshore barge cranes are required to install the deck to the platform.

As will be appreciated by those of skill in this art, the overall cross-sectional dimension, or resistance, presented to current of the single-column EDP 10 of the present invention at the surface of the water is less than that of conventional EDPs incorporating multiple columns, and approaches that of a SPAR type of platform. Additionally, the reduction in the number of columns substantially reduces the complexity, and hence, the fabrication costs, of the platform. And, because the deck 12 necessarily includes an open well bay at its center anyway, the deck area wasted by leg wells is substantially less than that of EDPs with multiple columns. Additionally, such an arrangement provides a better support of the weight of the deck and the equipment mounted thereon, compared with an EDP with multiple columns.

Figure 8:
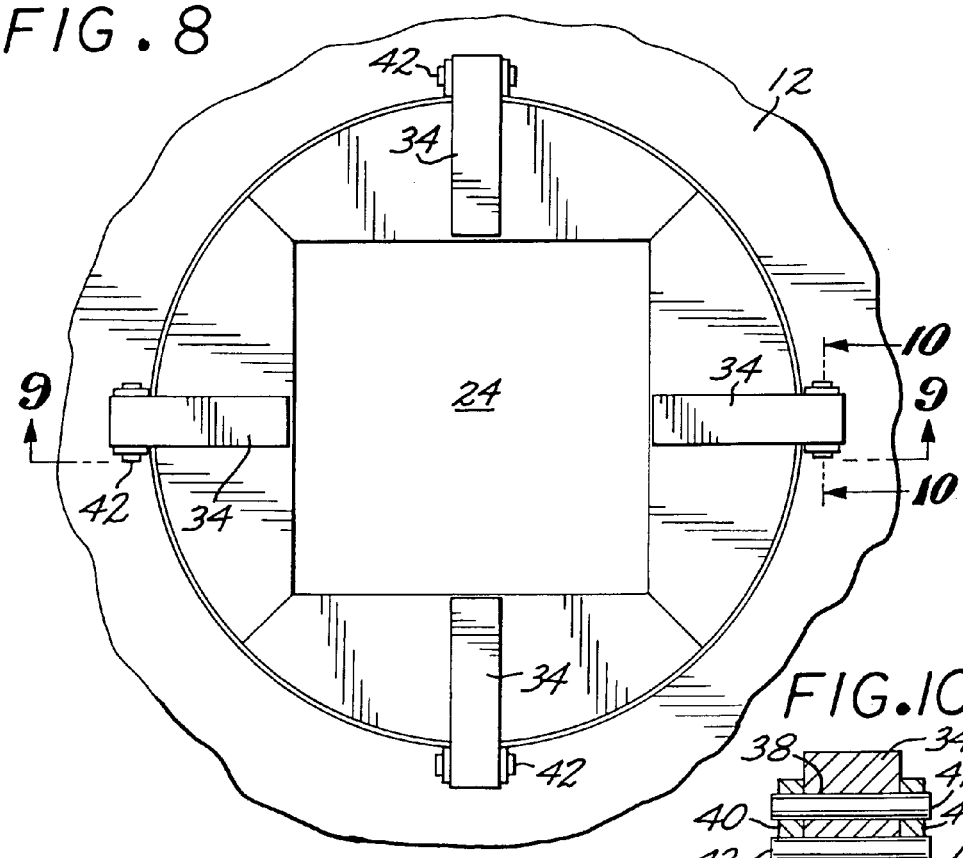
FIG. 8 is a partial top plan view of the upper end of the support column of the EDP taken along the lines 8—8 in FIG. 7.
Figure 10:
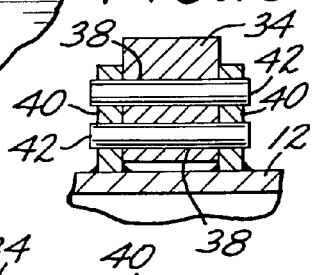
FIG. 10 is a partial cross-sectional view of the upper end of the support column of the EDP taken along the lines 10—10 in FIG. 8, showing locking pins inserted thereat.
Figure 9:
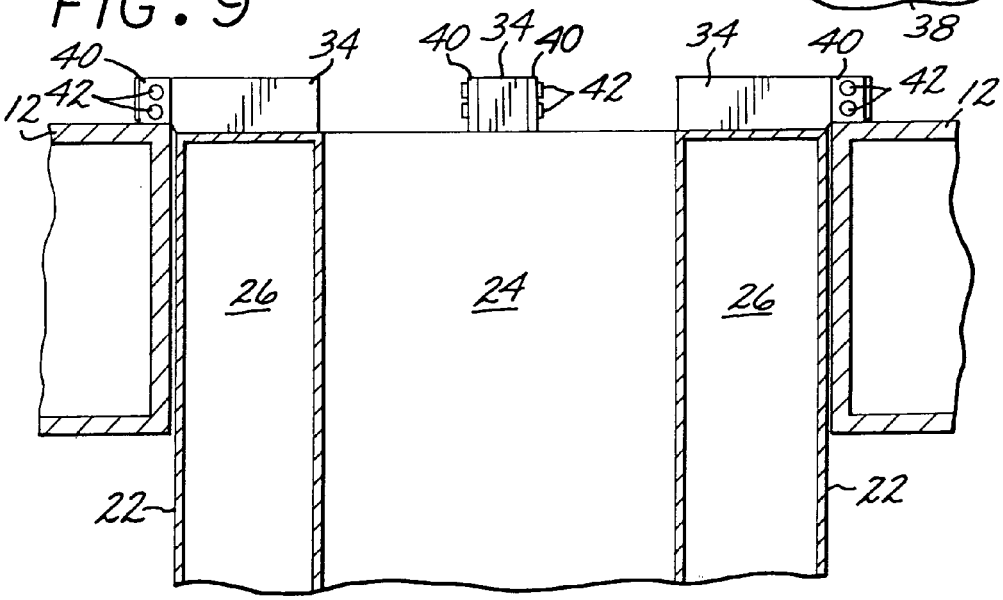
FIG. 9 is a partial cross-sectional view of the upper end of the support column of the EDP taken along the lines 9—9 in FIG. 8.
Figure 12:
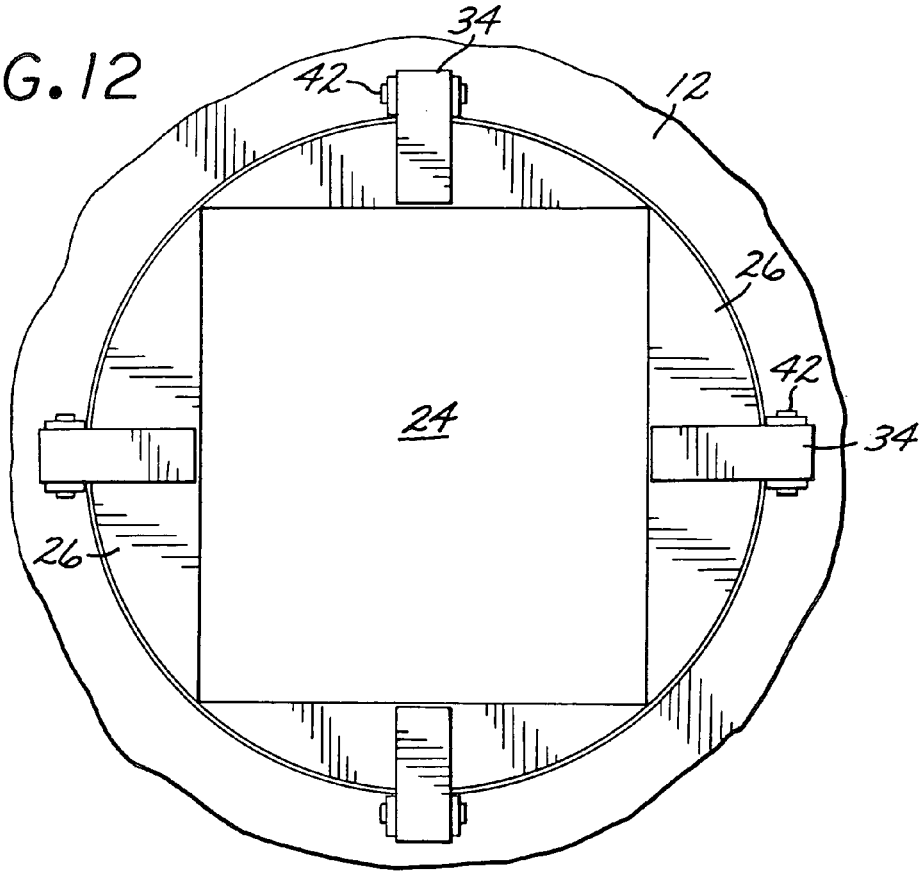
FIG. 12 is a partial top plan view of the upper end of the single support column of the EDP of FIG. 11 taken along the lines 12—12 therein.

To support the deck 12 on the upper end of the single column 22, a robust connection is required between the two, and suitable means are therefore provided in the exemplary EDP 10 for effecting such a connection. In the particular embodiments illustrated in the plan views of FIGS. 8 and 12, these supporting means comprise a "spider," or plurality of radial arms 34, which may comprise simple box beams, that are fixed to the upper end of the column, as illustrated in the figures. The inner ends of the arms terminate at the margins of the center well 24 of the column, which enables risers, drill stems and the like to pass vertically through the center well and between the upper surface of the deck and the sea floor below. The outer ends of the arms include circumferential locking pin apertures 38 disposed therein, as illustrated in FIG. 10.

One or more upstanding receptacles 40 are arranged on the upper surface of the deck 12 around the central opening 14 thereof to receive the outer ends of the arms 34 in a vertical, slide-in engagement when the upper end of the column 22 is lowered to the level of the deck during the pontoon and column ballasting procedure described above. The receptacles have locking pin apertures which correspond to the locking pin apertures 38 in the outer ends of the arms, and when the upper end of the column is lowered to the level of the deck, as illustrated in FIG. 6, locking pins 42 are inserted through corresponding ones of the locking pin apertures of the arms and the receptacles, as illustrated in FIG. 10, to lock the deck to the upper end of the column. If desired, the upper end of the column may also be welded to the deck to reinforce the connection between the two, and advantageously, with welds that can be easily removed later if it should become desirable to disconnect the deck from the column for movement of the platform to a different location. As those of skill in this art will appreciate, there are many other possible mechanisms for supporting the deck on the upper end of the column.

As discussed above, the EDP 10 of the present invention is very flexible in its design, and may take a variety of shapes and sizes. For purposes of description only, and not by way of limitation, an exemplary EDP may have a cylindrical support column 22 having a diameter of about 100 ft. and a height of about 225 ft., and incorporate a rectangular equipment deck 12 having a length of about 135 feet, and which, in an operating configuration, is supported on the upper end of the column at a height of about 35 ft. above the surface of the water.

Figure 16:
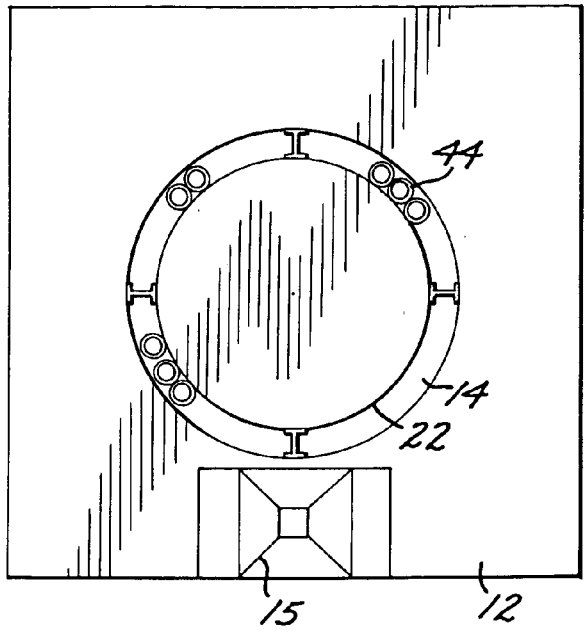
FIG. 16 is a top plan view of an another alternative embodiment of a single column EDP in accordance with the present invention; and, FIG. 17 is an elevation view of the EDP of FIG. 16.
Figure 17:
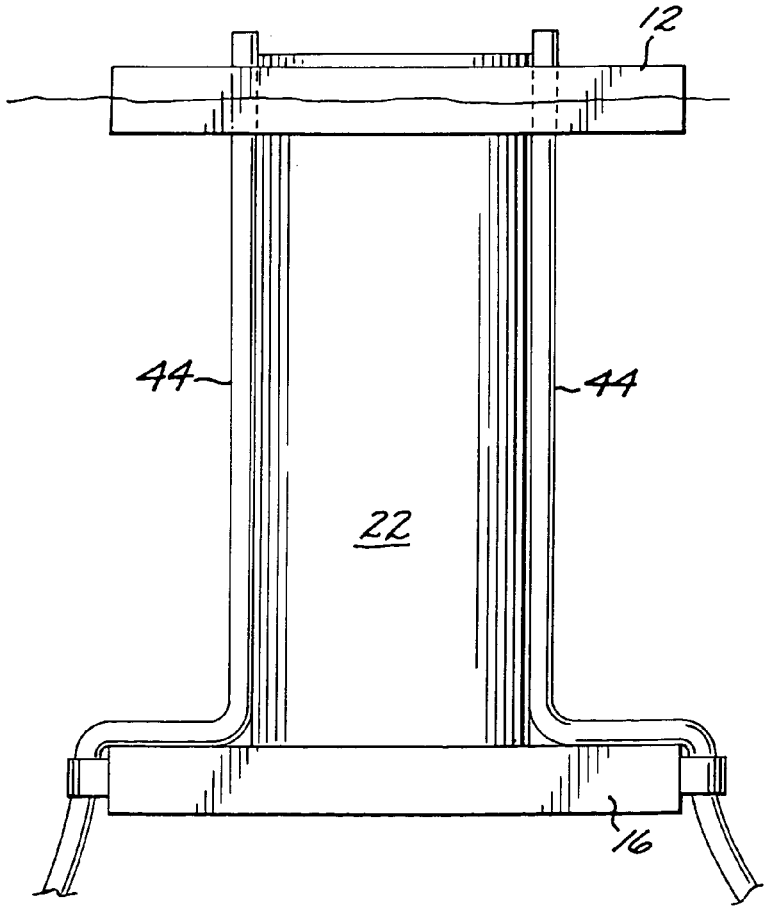

As will by now be evident to persons of skill in the art, many modifications, substitutions and variations can be made in and to the materials, methods and configurations of the EDP 10 of the present invention without departing from its spirit and scope. For example, it may be desirable in some applications to omit the respective center wells 18 and 24 of the pontoon 16 and column 22, and instead (or in addition to), provide an enlarged central opening 14 in the equipment deck 12 that enables risers 44 and the like to pass from the sea floor to the upper surface of the deck adjacent to the sides of the column, instead of (or in addition to) the center well thereof, as illustrated in FIGS. 16 and 17.

In light of the foregoing, it may be seen that the scope of the present invention should not be limited to the particular embodiments illustrated and described herein, as these are merely exemplary in nature, but rather, should be fully commensurate with that of the claims appended hereafter and their functional equivalents.

What is claimed is:

1. An extendable draft offshore platform (EDP), comprising:

a buoyant deck having a central opening;

a pontoon having an adjustable buoyancy;

a buoyant column having a lower end and an upper end, the lower end being attached to the pontoon and extending upwardly there from, the column being vertically movable through the central opening of the deck between a raised position and a lowered position as the pontoon is respectively raised and lowered by the adjustment of its buoyancy;

a plurality of radial arms fixed to the upper end of the column, each of the arms having an outer end extending radially beyond the periphery of the column;

a plurality of receptacles on the deck, arranged and configured to receive the outer ends of the radial arms in a vertical, slide-in engagement when the column is in its lowered position; and a locking element that is engageable with each of the arms and its corresponding receptacle when the arms are received in the receptacles so as to lock the upper end of the column to the deck.

2. The EDP of claim 1, wherein each of the pontoon and the column has a center well therein, and wherein the center well of the column is disposed concentrically over the center well of the pontoon.

3. The EDP of claim 1, wherein the column comprises one or more compartments, at least one of which has a buoyancy that is adjustable.

4. The EDP of claim 3, further comprising means for forcing sea water ballast into and out of the adjustably buoyant compartments.

5. The EDP of claim 4, wherein the water ballast forcing means comprise pressurized air or a pump.

6. The EDP of claim 3, wherein the compartments are tubular.

7. The EDP of claim 1, wherein the lower end of the column comprises an open truss structure.

8. The EDP of claim 1, wherein the horizontal periphery of at least one of the deck and the pontoon is polygonal.

9. The EDP of claim 1, further comprising an upright derrick movable on an upper surface of the deck between a first position over the central opening of the deck and a second position horizontally displaced from the first position.

10. The EDP of claim 1, wherein each of the radial arms has a first apertures in the outer end thereof; wherein each of the receptacles has a second aperture therethrough that is aligned with the first aperture when the outer end of an arm is received in the receptacle; and wherein each of the locking elements is a locking pin that is configured for insertion through the first and second apertures to rigidly lock the outer end of each of the arms into its corresponding receptacle.

* * * * *